United States Patent [19]

Long

[11] 4,253,937

[45] Mar. 3, 1981

[54] COAL LIQUEFACTION PROCESS

[75] Inventor: Robert B. Long, Atlantic Highlands, N.J.

[73] Assignee: Exxon Research & Engineering Co., Florham Park, N.J.

[21] Appl. No.: 935,567

[22] Filed: Aug. 21, 1978

[51] Int. Cl.[3] ..... C10G 1/00; C10G 1/06; C10B 57/08; C10B 57/04

[52] U.S. Cl. ..... 208/8 LE; 208/8 R; 208/10; 201/9; 201/23

[58] Field of Search ..... 208/8 LE, 8 R, 10; 201/9, 23

[56] References Cited

U.S. PATENT DOCUMENTS

| | | | |
|---|---|---|---|
| 2,166,321 | 7/1939 | Pott | 208/8 LE |
| 3,692,662 | 9/1972 | Wilson et al. | 208/8 LE |
| 3,791,957 | 2/1974 | Wolk | 208/10 |
| 3,970,541 | 7/1976 | Williams et al. | 208/8 LE |
| 3,997,424 | 12/1976 | Urquhart et al. | 208/8 R |
| 4,019,975 | 4/1977 | Urquhart | 208/10 |
| 4,036,730 | 7/1977 | Brink et al. | 208/8 LE |
| 4,036,731 | 7/1977 | Martin | 208/8 LE |
| 4,075,079 | 2/1978 | Lang | 208/8 LE |
| 4,082,643 | 4/1978 | Golsis et al. | 208/8 LE |
| 4,090,942 | 5/1978 | Beuther et al. | 208/8 R |

*Primary Examiner*—Delbert E. Gantz
*Assistant Examiner*—William G. Wright
*Attorney, Agent, or Firm*—Marthe L. Gibbons

[57] ABSTRACT

Particulate coal is contacted with a hydrogen donor solvent, preferably a vapor phase hydrogen donor solvent, to swell the coal particles and, thereafter, the swollen coal particles are subjected to coal liquefaction conditions in the absence of liquid phase solvent.

18 Claims, 1 Drawing Figure

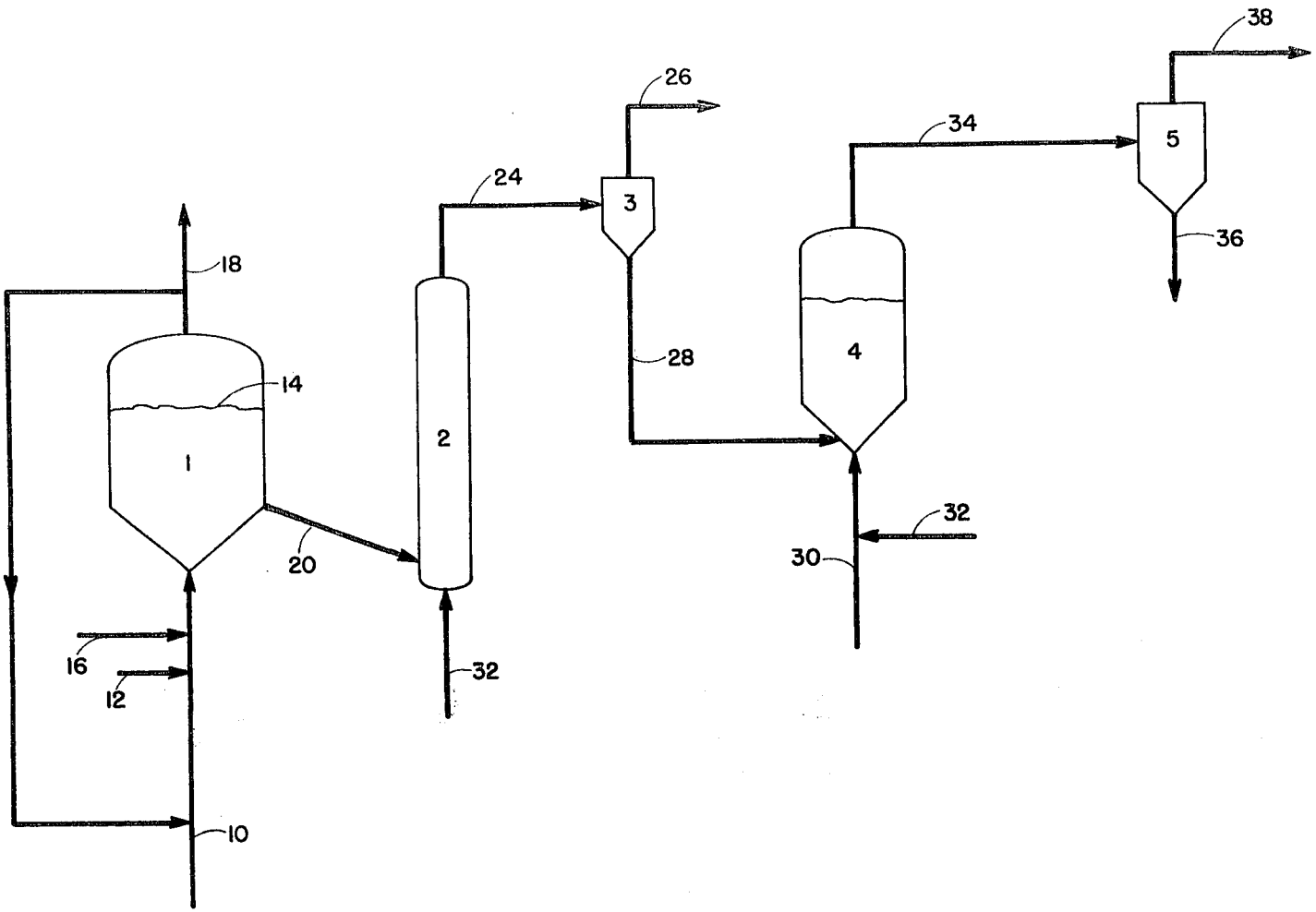
38
36
5
34
32
4
30
26
28
3
24
2
32
20
14
18
1
10
16
12

COAL LIQUEFACTION PROCESS

BACKGROUND OF THE INVENTION

1. Field of the Invention

The present invention relates to an improved coal liquefaction process. More particularly, the invention relates to a process comprising pretreatment of solid coal particles with a hydrogen donor solvent followed by coal liquefaction in the absence of liquid phase solvent.

2. Description of the Prior Art

Coal liquefaction processes in which coal with or without a diluent is subjected to elevated temperatures and pressures to convert the coal to normally liquid hydrocarbonaceous products are well known. Coal liquefaction processes in which coal is converted in the presence of a hydrogen donor diluent with or without added molecular hydrogen are also known. See, for example, U.S. Pat. No. 3,645,885; U.S. Pat. No. 3,617,513, and U.S. Pat. No. 3,841,991, the teachings of which are hereby incorporated by reference.

It is also known to liquefy coal in the presence of a vapor phase solvent which comprises a hydrogen donor, see for example, U.S. Pat. No. 3,997,424 and U.S. Pat. No. 4,036,731.

U.S. Pat. No. 3,692,662 discloses a staged coal liquefaction process in which a slurry of coal in a solvent, such as a hydrogen donor solvent, is maintained at a temperature below 700° F. to effect formation of a dispersion and, thereafter, the dispersed slurry is heated to a temperature above 700° F.

It is also known to produce liquid hydrocarbons by a fluid coking process in which coal particles are slurried in a hydrogen donor solvent (see U.S. Pat. No. 3,841,991). Fluid coking of a coal in a water slurry is also known (see U.S. Pat. No. 3,272,720).

U.S. Pat. No. 3,970,541 discloses a process for gas extraction of coal. The coal and solvent are heated to 370° C. at a rate of 20° C. per minute and thereafter to 400°-500° C. at a rate of less than 10° C. per minute. The solvent is preferably in the gas phase over the greater part of the range in which the slower rate of heating is performed.

U.S. Pat. No. 3,791,957 discloses a coal pretreatment at a pressure in excess of 1000 psig in the presence of added hydrogen at a temperature from 600° to 750° F. followed by catalytic ebullating bed coal hydrogenation.

It has now been found that pretreatment of the solid coal particles with a solvent to effect a specified amount of swelling of the particles gives improved coal liquefaction results such as an increased yield of coal liquids.

SUMMARY OF THE INVENTION

In accordance with the invention, there is provided, in a coal liquefaction process wherein particulate coal is converted to a hydrocarbonaceous oil in the absence of a liquid phase solvent in a coal liquefaction zone at coal liquefaction conditions, the improvement which comprises:

(a) contacting said particulate coal with a fluid hydrogen donor solvent at a temperature ranging from about 150° to about 350° C. and at a pressure ranging from about 10 to about 150 psig, for a time sufficient for said coal to sorb at least a portion of said solvent and thereby swell and increase in weight by at least 3 weight percent, and (b) subsequently subjecting the resulting swollen coal to said coal liquefaction conditions.

The term "coal" is used herein to designate a normally solid carbonaceous material including all ranks of coal, such as anthracite coal, bituminous coal, semi-bituminous coal, subbituminous coal, lignite, peat and mixtures thereof.

BRIEF DESCRIPTION OF THE DRAWING

The FIGURE is a schematic flow plan of one embodiment of the invention.

DETAILED DESCRIPTION OF THE INVENTION PRETREATMENT STAGE

Particulate coal is contacted with a fluid hydrogen donor solvent, that is, with either a liquid phase or a vapor phase hydrogen donor solvent, preferably with a vapor phase hydrogen donor solvent at a temperature below coal liquefaction temperature, generally at a temperature ranging from about 150° C. to about 350° C., preferably at a temperature ranging from about 204° to 350° C., more preferably at a temperature ranging from about 204° to 310° C., most preferably at a temperature ranging from about 204° to 250° C., and at a pressure ranging from about 10 to about 150 psig for a time sufficient for the coal to sorb at least a portion of the solvent and to become swollen, that is, the weight of the coal will be increased at least about 3 weight percent. Generally, the coal particles will be treated for a time sufficient to increase the weight of the coal from about 3 to about 50 weight percent, preferably from about 5 to about 50 weight percent relative to the initial untreated coal. The initial particle size of the coal prior to treatment with the solvent will generally range from about 0.01 to about 0.25 inches in diameter, preferably from about 0.05 to 0.13 inches in diameter. Suitable contacting time will generally range from about 10 to about 100 minutes.

The fluid hydrogen donor solvents useful in the practice of the present invention, defined in terms of hydrogen donor potential are hydrogen donor solvents which contain at least 0.8 weight percent, preferably 1.2 to 3 weight percent donatable hydrogen based on the weight of the solvent, preferably a vapor phase hydrogen donor solvent. The hydrogen donor solvent may be any of the known hydrogen donor solvents. The hydrogen donor solvent will typically be an intermediate stream boiling at atmospheric pressure between 350° F. and about 800° F., preferably between 400° F. and about 700° F. derived from a coal liquefaction reaction. This stream contains hydrogenated aromatics, naphthenic hydrocarbons, phenolic materials, partially hydrogenated quinolines and similar compounds that will normally contain at least 30 weight percent, preferably at least 50 weight percent of compounds which are known to be hydrogen donor under the temperature and pressure conditions employed in the coal liquefaction zone. Other hydrogen-rich solvents derived from petroleum or from other sources such as synthetic fuels may be used instead or in addition to such coal derived liquids, particularly on initial start up of the process. Suitable hydrogen donor compounds added to or originally present in the hydrogen donor solvent include indane, $C_{10}$ to $C_{12}$ tetralins, decalins, hydrogenated methylnaphthalene, hydrogenated dimethylnaphthalene, hydrogenated $C_{12}$ and $C_{13}$ acenaphthenes, tetrahydroquinolines, partially hydrogenated heterocyclic compounds and similar donor compounds.

Suitable solvent to coal weight ratio for use in the pretreatment stage include a weight ratio ranging from about 0.05 part solvent: one part coal to one part solvent: one part coal.

After the coal particles and solvent have been in contact for a time sufficient to swell the coal particles to a desired extent, the swollen coal particles are subjected to coal liquefaction conditions. If desired, in some embodiments of the invention, the entire effluent of the coal pretreatment stage can be passed to a coal liquefaction zone, if the solvent used was a vapor phase solvent. When the solvent used is a liquid phase solvent, the swollen coal particles would have to be separated by conventional techniques, such as filtration, from the liquid phase solvent prior to subjecting the swollen coal to coal liquefaction conditions.

COAL LIQUEFACTION STAGE

The coal liquefaction zone can be operated at any of the conventional coal liquefaction conditions known to be suitable to convert coal to coal liquids. In accordance with the process of the present invention, the coal liquefaction reaction must be conducted in the absence of a liquid phase solvent. If desired, a gas containing molecular hydrogen may be introduced into the coal liquefaction zone directly or indirectly, that is, by adding a molecular hydrogen-containing gas to the coal pretreatment zone and subsequently introducing the entire pretreatment zone effluent comprising the molecular hydrogen-containing gas into the coal liquefaction zone.

Suitable coal liquefaction conditions include a temperature ranging from about 371° C. to about 705° C., preferably a temperature ranging from about 398° C. to about 705° C., more preferably a temperature ranging from about 426° C. to about 594° C. and a pressure ranging from about 0 to about 3,000 psig, preferably from about 10 to about 150 psig.

Suitable reaction time in a coal liquefaction zone include from less than 1 minute to about 2 hours, preferably from about 5 to about 90 minutes.

The coal liquefaction reaction is conducted for a time sufficient to convert coal to the desired amount of hydrocarbonaceous normally liquid oil product. By "normally liquid" is intended herein that the product is liquid at atmospheric pressure and ambient temperature.

When the coal liquefaction reaction is conducted in the presence of an added molecular hydrogen, suitable hydrogen partial pressure may range from about 10 psig to about 3000 psig, preferably from about 10 to about 150 psig. The effluent of the coal liquefaction zone comprises a solid residue (char plus unconverted coal plus ash) and a vapor phase product which includes gases and a normally liquid hydrocarbonaceous oil product. The effluent may be passed through a separation zone. The solids may be separated by conventional means from the vapor phase product.

DESCRIPTION OF THE PREFERRED EMBODIMENT

The preferred embodiment will be described with reference to the accompanying figure.

Referring to the figure, a vaporized solvent, for example, tetralin is introduced by line 10 into vessel 1 which contains a fluidized bed of coal having an upper level indicated at 14. The coal particles in the bed will generally be particles ranging from about 40 to about 1000 microns in size. Additional coal particles are introduced into solvent line 10 via line 12. The vaporized tetralin is introduced into vessel 1 at a velocity sufficient to maintain the coal particles in a fluidized state, for example, a superficial fluidizing velocity in the range from about 0.5 to 5 feet per second. In vessel 1, the pretreatment stage of the present invention is carried out. The fluidized bed coal pretreatment zone is maintained at a temperature ranging from about 150° C. to about 350° C. and at a pressure ranging from about 10 to about 150 psig. The coal particles are maintained in fluidized state by the flow of vapor phase solvent through the bed of coal. If desired, a molecular hydrogen-containing gas may also be introduced into vessel 1 by injecting the gas into line 10 via line 16. The hydrogen-containing gas may be substantially pure hydrogen or a gaseous mixture containing other gases such as off gases from reforming processes, etc. The coal and vapor phase tetralin are contacted in vessel 1 for a period of time sufficient for the coal particles to sorb a portion of the vaporous tetralin and become swollen coal particles. The coal is sufficiently swollen when it has increased in weight by about 3 to bout 50 percent relative to the initial weight of the coal. Suitable residence time in vessel 1 includes from about 10 minutes to about 100 minutes. A portion of the vapors of vessel 1 is removed overhead via line 18. The overhead comprises the solvent. If desired, the solvent may be fractionated by conventional means and at least a portion thereof may be recycled to vessel 1. Furthermore, the solvent may be hydrogenated in a conventional way to improve its hydrogen donor properties. A stream of swollen coal particles is removed via line 20 and introduced into transferline pyrolysis reactor 2. A hot carrier gas is introduced into reactor 2 via line 22. The carrier gas may be a molecular hyrogen-containing gas, for example, gas produced by gasification of the char resulting from the liquefaction process. In the transferline pyrolysis reactor, the swollen coal is converted to normally liquid hydrocarbonaceous oil and a solid residue. That is, the coal liquefaction stage is conducted in this preferred embodiment in the transferline pyrolysis reactor. It should be noted that the coal liquefaction should be conducted in the absence of any added liquid solvent. Suitable transferline temperatures include from about 371° C. to about 705° C. and a pressure ranging from about 10 to about 150 psig.

The vaporous effluent of the transferline reactor comprises a normally liquid hydrocarbonaceous oil, gases and a solid residue. The effluent is passed via line 24 to a separation zone 3 in which the solid residue including char is removed from the vapor phase products. The vapor phase products are removed from separation zone 3 by line 26. The separated solid residue is removed by line 28 and passed to gasification vessel 4. Vessel 4 is operated as a fluidized bed gasification zone in which the solid residue including char is fluidized by gases introduced into vessel 4. The gasification zone is maintained at a temperature ranging from about 760° C. to about 1093° C., preferably at a temperature ranging from about 926° C. to about 1037° C., and a pressure ranging from about 10 to about 150 psig. A molecular oxygen-containing gas such as air, commercial oxygen or air enriched with oxygen is introduced into gasification vessel 4 via line 30. Steam is introduced into line 30 via line 32. The mixture of steam and oxygen-containing gas fluidizes the solid residue and reacts with the char to produce the hydrogen-containing gas. The effluent of the gasification zone is passed via line 34 to a separation zone 5 wherein the remaining solid residue (char and ash) is removed via line 36. The hydrogen-containing gas is recovered via line 38. The hydrogen-containing gas may be used as such or scrubbed in a conventional way. If desired, at least a portion of this hydrogen-containing gas may be recycled to transferline reactor 2.

The following examples are presented to illustrate the invention.

EXAMPLE 1

A small vertical continuous flow reactor was built which would hold about 15 g of coal. At the bottom, a boiler was installed to vaporize completely the solvent pumped to it so that the solvent vapors passed up through the granular fixed bed of 10–20 mesh coal. The coal was held at a temperature and pressure such that none of the solvent vapors would condense as liquid on the coal. To start a run, the coal was charged to the reactor, the boiler and coal were heated to above the boiling point of the solvent, the solvent was started to the boiler, and, if desired, hydrogen flow was started also to the boiler.

During the run, the coal was gradually heated to pyrolysis temperature of normally 550° C. over a period of 30 minutes and held at that temperature for a period of a few hours under flowing solvent vapors and hydrogen. This warm-up gave the coal a chance to swell in the presence of the solvent vapors. The liquid and gaseous products were taken off as a vapor, condensed, and collected in cold traps at room temperature and dry ice temperature. Thus, the products were taken overhead in the vapor phase. To terminate the run, solvent feed was stopped, the coal was cooled under flowing hydrogen, and then removed from the reactor tube. Thus the coal was never contacted with liquid solvent.

The weight of coal recovered was used as an indicator of total conversion and the amount of liquid product was conservatively estimated by distilling the solvent from the condensed liquids. In this way any coal liquids boiling at or below the boiling point of the solvent would not be counted as coal liquid yield.

Table I shows a comparison of a number of runs at atmospheric pressure using 14.89 g charges of dried Wyodak coal and various donor and non-donor solvents.

TABLE I

| Solvent | Hydrogen Flow | Temperature °C. | Coal Recovered Grams | Coal Recovered wt. % | Liquid Yield Grams | Liquid Yield wt. % |
|---|---|---|---|---|---|---|
| None | Yes | 550 | 10.05 | 67.5 | 1.92 | 12.9 |
| THQ[a] | Yes | 400 | 9.04 | 6.07 | 3.31 | 22.2 |
| THQ[a] | Yes | 550 | 5.46 | 36.7 | 6.87 | 46.1 |
| Quinoline | Yes | 550 | 10.40 | 69.8 | 0.98 | 6.6 |
| HCO[b] | Yes | 550 | 9.37 | 62.9 | 3.20 | 21.5 |
| Tetralin | Yes | 550 | 9.26 | 62.2 | — | — |
| Tetralin | No | 550 | 9.11 | 61.2 | — | — |
| THQ[a] | No | 550 | 4.97 | 33.4 | 6.44 | 43.2 |

[a]THQ = Tetrahydroquinoline
[b]HCO = Hydrogenated Coal Liquids Fraction

The data of Table I show that the presence of donor solvent during the warm-up period and the pyrolysis period has a significant effect on both the conversion of the coal and the selectivity to liquids. Tetralin, THQ, and HCO are all hydrogen donors, while quinoline is not. The run with no solvent was made with the same time/temperature history as the other runs. All the donor runs increased both conversion and liquid yield, while the non-donor solvent, quinoline, actually reduced both as compared to the comparative run. These results show that a hydrogen donor solvent is needed in the pretreatment of the present invention to maximize liquid yield on pyrolysis.

EXAMPLE 2

Dry Wyodak (10/20 mesh coal) was contacted with solvent vapors of tetralin, two recycle solvents, tetrahydroquinoline and diphenylmethane for long time periods (~10–14 days) until approximately 4.5–5.5 wt.% solvent had been inbibed in the coal. Samples were then pyrolyzed at ~500° C. for one hour under $N_2$. Table II gives yield structure and conversion data with comparisons with untreated coal. The assumption is made that the solvent picked up is distillate liquid upon pyrolysis and yields are thus based on coal. Conversion in the untreated case is 31±1% on a DAF basis (ash balance) while conversions in the solvent swell cases run from 38% with tetralin to 42% with THQ.

TABLE II

PYROLYSIS OF ROOM TEMPERATURE PRETREATED COALS (480°–520° C.)

| Solvent | Wt. % Solvent Pickup | Product Yield, Wt. % Coke | Product Yield, Wt. % Liquid | Product Yield, Wt. % Gas | DAF % Conversion Ash Balance | DAF % Conversion 100 Coke |
|---|---|---|---|---|---|---|
| None | — | 68 | 12 | 20 | 31 | 35 |
| Tetralin | 5.5 | 65 | 13 | 22 | 38 | 38 |
| Recycle (DH~0.9) | 4.8 | 68 | 16 | 14 | 39 | 35 |
| Recycle (DH~2) | 5.5 | 63 | 16 | 21 | 41 | 40 |
| THQ | 4.9 | 63 | 18 | 19 | 42 | 40 |

DH = Donatable Hydrogen, wt. % on solvent.

The data of Table II show that pre-swelling the coal with a donor solvent not only increases liquid yield but also increases total conversion on pyrolysis.

What is claimed is:

1. In a coal liquefaction process wherein particulate coal is converted to a hydrocarbonaceous oil in the absence of a liquid phase solvent, in a coal liquefaction zone, at coal liquefaction conditions, the improvement which comprises:
   (a) contacting said particulate coal with a fluid hydrogen donor solvent at a temperature ranging from about 150° to about 350° C. and at a pressure ranging from about 10 to about 150 psig for a time sufficient for said coal to sorb at least a portion of said solvent and thereby swell, and increase in weight by at least about 3 weight percent, and
   (b) subsequently subjecting the resulting swollen coal to said coal liquefaction conditions.

2. The process of claim 1 wherein said fluid hydrogen donor solvent is a vapor phase solvent.

3. The process of claim 1 wherein said fluid hydrogen donor is a liquid phase solvent.

4. The process of claim 1 wherein said temperature of step (a) ranges from about 204° to about 310° C.

5. The process of claim 1 wherein said particulate coal is contacted with said solvent for a period of time ranging from about 10 to about 100 minutes.

6. The process of claim 1 wherein the solvent to coal weight ratio ranges from about 0.05:1 to 1:1 in said contacting step.

7. The process of claim 1 wherein said coal liquefaction is conducted in the presence of added molecular hydrogen.

8. The process of claim 1 wherein said coal liquefaction conditions include a temperature ranging from about 371° C. to about 705° C.

9. The process of claim 1 wherein said coal liquefaction conditions include a pressure ranging from about 0 to about 3,000 psig.

10. The process of claim 1 wherein said coal liquefaction conditions include a pressure ranging from about 10 to about 150 psig.

11. In the process of claim 1, the improvement which comprises the additional steps of separating the effluent of said coal liquefaction zone into a vapor phase product and a solid residue, and contacting said solid residue with steam and an oxygen-containing gas to produce a hydrogen-containing gas.

12. The process of claim 1 wherein said coal is contacted with said solvent in step (a) for a time sufficient for said coal to increase in weight from about 3 to about 50 percent based on the initial weight of said coal.

13. The process of claim 1 wherein said temperature of step (a) ranges from about 204° to 250° C.

14. The process of claim 2 wherein said particulate coal in step (a) is maintained in a fluidized bed, said vapor phase solvent being the fluidizing agent.

15. A process for converting particulate coal to a normally liquid hydrocarbonaceous oil, which comprises:

(a) contacting said coal with a vapor phase hydrogen donor solvent in a fluidized bed zone maintained in a fluidized state by a fluidizing gas comprising said vapor phase solvent, said zone being maintained at a temperature ranging from about 150° to about 350° C. and at a pressure ranging from about 10 to about 150 psig, said contacting being for a time sufficient for said coal to sorb at least a portion of said solvent and thereby produce swollen coal, said swollen coal being increased in weight of said coal by at least 3 weight percent;

(b) subjecting the resulting swollen coal to coal liquefaction conditions, in the absence of a liquid phase solvent, in a coal liquefaction zone, maintained at a temperature ranging from about 371° C. to about 705° C. and at a pressure ranging from about 10 to about 150 psig for a time sufficient to convert at least a portion of said coal to a normally liquid hydrocarbonaceous oil;

(c) separating the effluent resulting from said coal liquefaction zone into a vapor phase product and a solid residue, and (d) contacting at least a portion of said solid residue with steam and an oxygen-containing gas in a gasification zone maintained at a temperature ranging from about 760° to about 1093° C. to produce a hydrogen-containing gas.

16. The process of claim 15 wherein said fluidizing gas of step (a) additionally comprises molecular hydrogen.

17. The process of claim 15 wherein a molecular hydrogen-containing gas is introduced into said coal liquefaction zone of step (b).

18. The process of claim 15 wherein said temperature of step (a) ranges from about 204° to 250° C.

* * * * *